United States Patent [19]

Hasselbacher

[11] 4,158,512

[45] Jun. 19, 1979

[54] CONNECTOR FOR SPACED METAL PARTS

[76] Inventor: Wilhelm Hasselbacher, 8530 Neustadt, Aisch, Fed. Rep. of Germany

[21] Appl. No.: 826,150

[22] Filed: Aug. 19, 1977

[30] Foreign Application Priority Data

Aug. 31, 1976 [DE] Fed. Rep. of Germany ..... 2639113
Apr. 4, 1977 [DE] Fed. Rep. of Germany ..... 2715007

[51] Int. Cl.[2] ..... E04B 1/62

[52] U.S. Cl. ..... 403/294; 52/732; 52/804; 403/331; 49/DIG. 1

[58] Field of Search ..... 403/294, 331; 52/619, 52/620, 621, 732, 804, 807, 785; 49/501, DIG. 1, DIG. 2

[56] References Cited

U.S. PATENT DOCUMENTS

| | | | |
|---|---|---|---|
| 3,373,538 | 3/1968 | Prager | 52/619 X |
| 3,517,472 | 6/1970 | Toth | 52/732 X |
| 3,750,333 | 8/1973 | Vance | 52/620 X |
| 3,878,660 | 4/1975 | Jacob | 49/DIG. 1 X |
| 4,070,838 | 1/1978 | Kuhn | 49/DIG. 1 X |

FOREIGN PATENT DOCUMENTS

| | | | |
|---|---|---|---|
| 567170 | 9/1975 | Switzerland. | |
| 1042038 | 9/1966 | United Kingdom | 49/DIG. 1 |

*Primary Examiner*—Andrew V. Kundrat

[57] ABSTRACT

A strip-form connector for spaced metal parts such as aluminium plates or components of windows or doors, is devised so as to perform an insulating or non-cold-bridge as well as fastening function. Basically it is made up of a hollow elongate body of plastics material with a more rigid fastening strip which is driven into the body so as to enlarge it into gripping engagement with the metal parts.

9 Claims, 10 Drawing Figures

Figure 1:
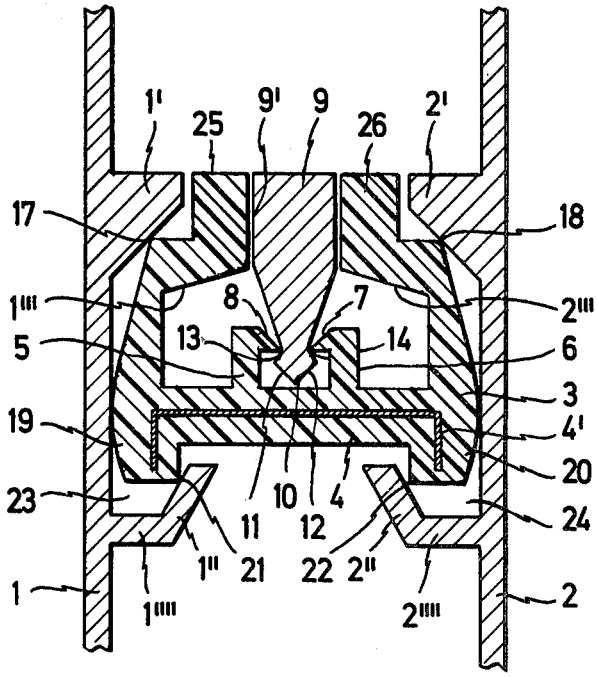

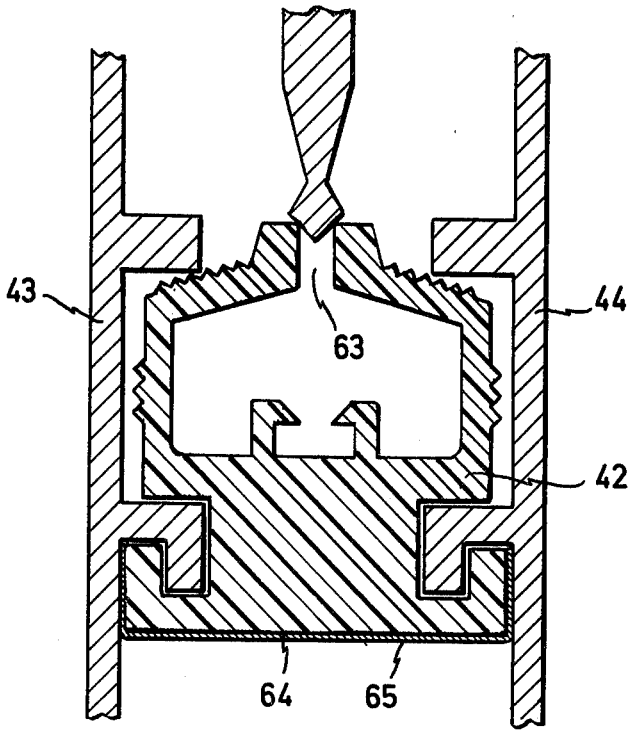
FIG. 5
FIG. 6
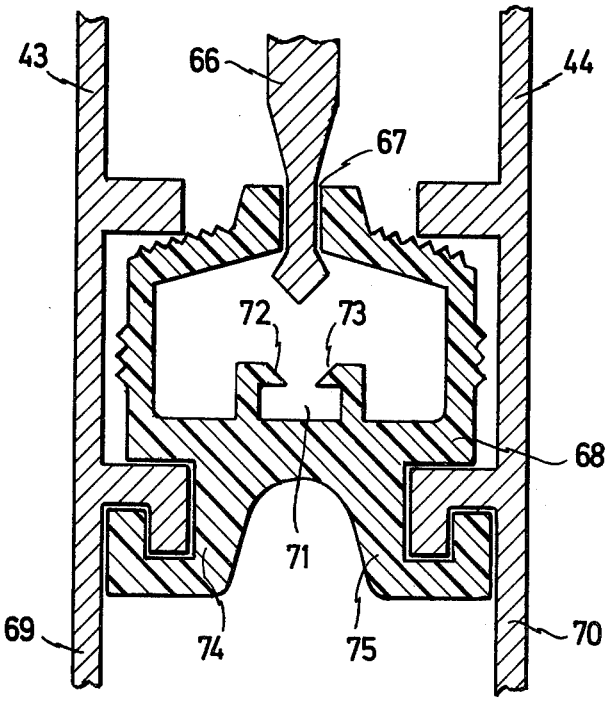
FIG. 7
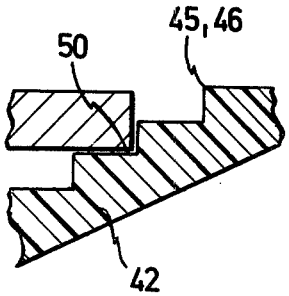

CONNECTOR FOR SPACED METAL PARTS

It is a well known technical convention that metal parts, for example metal plates (e.g. aluminum which are used for windows and doors, are kept spaced so that the metal parts do not make direct contact and form a cold bridge, and various heat insulating connections have been used to this end. Thus for example the two metal plates have been kept apart by tools and a connecting strip of plastic foam introduced between them. This system however requires substantial machine and tool outlay and moreover the stability of the cells of the foam in many instances breaks down under the influence of fluctuating thermal conditions. Again, since a connection through the medium of foamed material can only be released with difficulty, if at all, from the metal parts, it is impossible to give subsequent treatment or finish to the metal parts, for example anodising.

U-shaped fully plastic elements are also known which can be introduced into the connection zone in mirror-image fashion to define a hollow space which can then be filled with plastic foam. This also requires considerable outlay in machine and tool costs. There may be buckling of the profiled shape as a result of thermal fluctuations, and especially in this case the connection between the foam filling and the metal parts can only be subsequently finished and anodised with difficulty.

It is also known to use a strip of solid plastics material which is drawn laterally into the extended connection zone. On the one hand this solid profile is difficult to pull in without difficulty over long lengths, and on the other hand produces heat conservation problems because of the uniform degree of hardness of the solid profile.

The present invention is concerned with an elongate or strip-form connector for two spaced metal parts, for example two parallel light metal plates which comprises a plastic profiled elongate body which is held or anchored to at least one of the metal parts and a separate strip for insertion in said body to enlarge the same and form a fastening between said metal parts.

It is an object of this invention to provide an elongate connector of the type set forth above, primarily of a heat insulating character, which can not only be applied in substantial lengths in very simple fashion, but which will in its effective working position exhibit a major sealing effect.

This object is accomplished in accordance with the present invention by the fact that the plastic profiled body is hollow and comprises at least one bottom wall portion, side wall portions, and upper wall portions connected to the side wall portions, and the fastening strip is in the form of a wedge held between the upper wall portions and engaged with the bottom wall portions in its fastening position.

In a preferred embodiment of the invention at least one transition area of the plastic profiled body is rounded adjoining the side wall portion. Moreover at least one transition area of the plastic profiled body adjoining the side wall portions will advantageously extend approximately at right angles to the latter or defines with it an angle of less than 45°, for example approximately 30°.

Substantially L-shaped metal ribs may be provided on the metal parts for holding or anchoring the plastic profiled body and, in accordance with a feature of the invention, the bearing surfaces of the free limbs of the metal ribs may define with the inner faces of the adjacent metal part, an angle of more than 45° but less than 80°. Such inclinations of the holding ribs or bearing surfaces of the metal parts means a decisive simplification in the introduction of the plastic profiled body in a non-spread condition. Moreover there is correct centering and application of the profiled body in the metal parts, as a consequence of the subsequent enlargement of the latter—which thus means extremely small tolerances.

Preferably the rounded area or the angled bearing surfaces above and below the side wall portion of the plastic profiled body are of like form, for example in a mirror-image arrangement.

Again advantageously the opposed marginal surfaces of the upper wall portions of the profiled body extend parallel to one another or at a slight inclination to one another.

Preferably opposed resilient ribs or like projections are provided on the bottom wall portion of the plastic profiled body and project into the hollow interior of the body for resilient engagement with an enlarged head or the like on the wedge strip.

Whilst the accurate application of the plastic profiled body to the metal parts gives a good sealing effect and thus is particularly suited for some utility purposes, in other instances this sealing effect may not be absolutely essential. In the first case only small manufacturing tolerances can be accepted, which means an increase in the cost of the connector.

To cater for use of the plastic profiled body of the type mentioned in the foregoing where the metal parts to be connected are of different shapes or are made under relatively high tolerance limits, it is possible within this invention to use a modified cost-saving procedure. The invention is also usable in cases in which for example the metal parts which are arranged in mirror-image fashion are provided with different or differently-formed upper and lower projections.

In this instance the side wall portions of the plastic profiled body may be applied against the upper projections of the metal parts by a strip of wedge form, in each case linear contact only being made and this parallel to the axis. This linear contact has suprisingly been found not only to cater for the required firm connection but also to allow for sufficient heat insulation between the metal parts, accepting a slightly reduced sealing effect; this is due to the fact that air itself is known to have a heat insulating effect which may be adequate in some instances.

Since comparatively large tolerances are now acceptable in the manufacture of the projections of the metal parts, the connection directly between the two upper projections in the active position of the plastic profiled body need not be continuous. It is also possible for the strip to have a tip which contacts the bottom wall portion of the body when in working position.

If it is assumed that the strip will bring about a uniform overall spreading of the plastic body, special shaping of the latter will mean that the hollow area will be divided between the side wall portions into two areas. If these two separate areas are of a small diameter, that is to say for example not more than 6–8 m/m, they will provide for additional heat insulation.

The surfaces of the side wall portions of the plastic profiled body facing the metal parts may be provided with curved enlargements. This will absorb coarse tolerances in manufacture of the metal parts because there will be a flat application between the side wall portions and the metal parts between the upper and lower projections.

The side wall portions may advantageously be notched or the like, at least in the zone of contact with the upper projections of the metal parts. This notching caters for a stepped spreading and retention of the side wall portions against the inward projections during the insertion of the strip.

Rounded protuberances with ribs or the like extending in the longitudinal direction may also be provided.

Preferably the fastening strip is provided with a closure plate. It can also be of metal.

Figure 2:
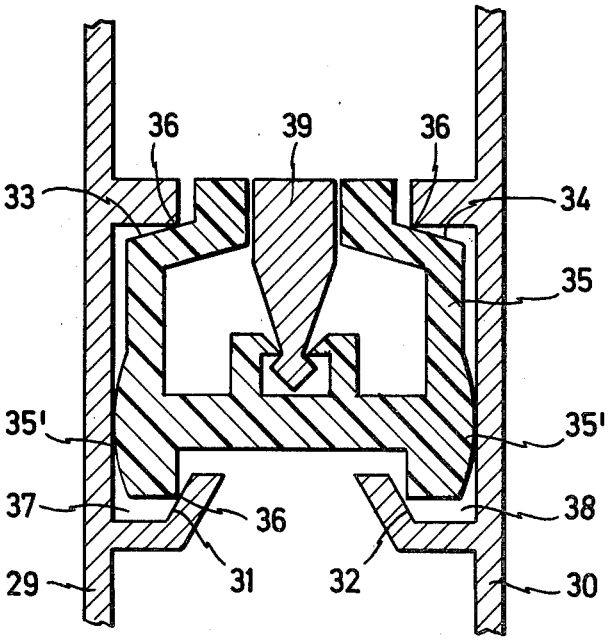
Figure 3:
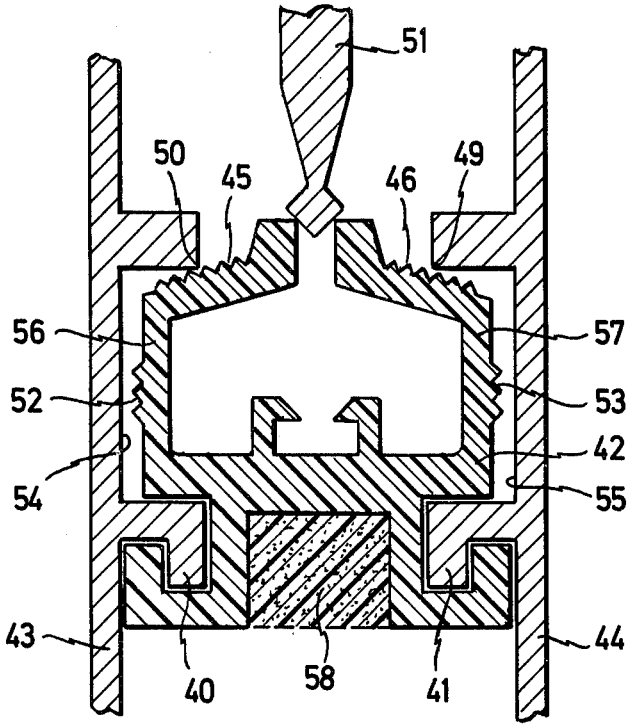
Figure 4:
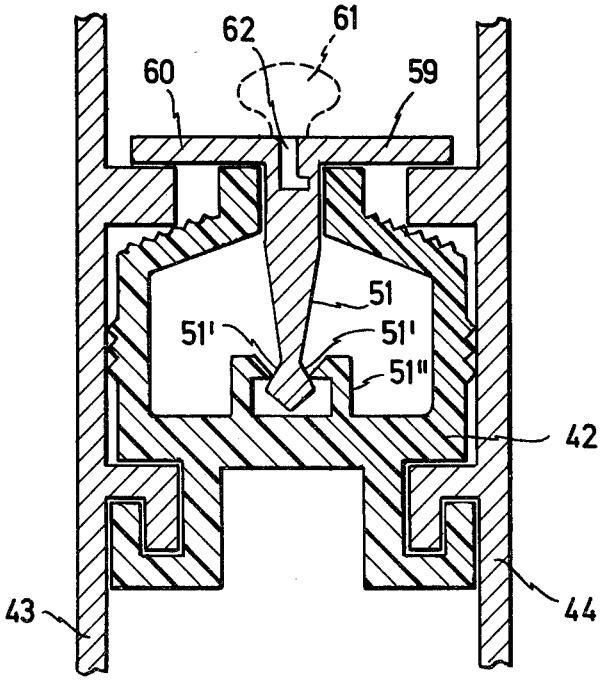
Figure 8:
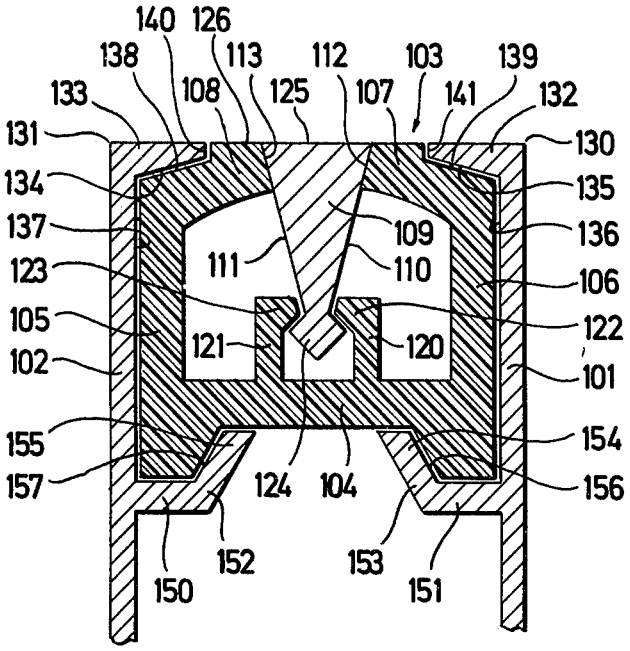
Figure 9:
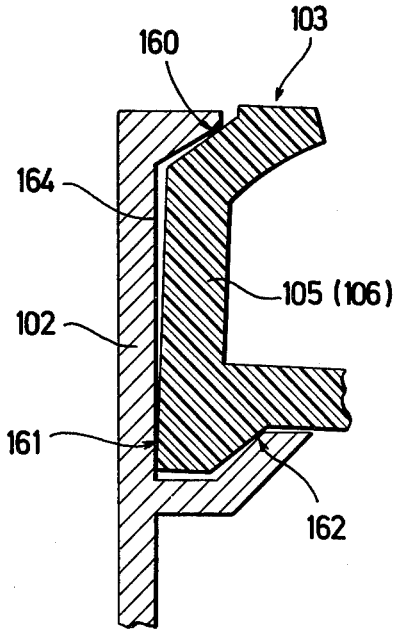
Figure 10:
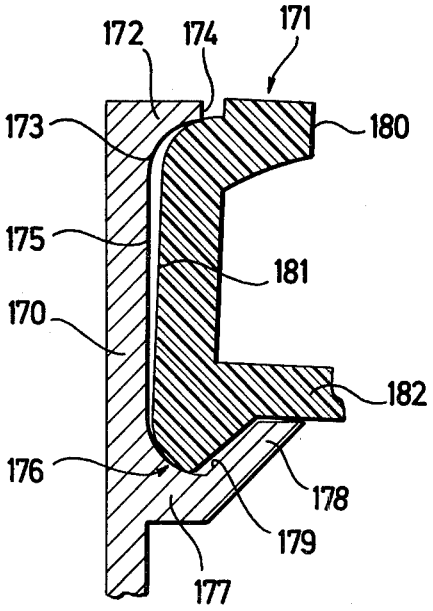

Embodiments of the invention are illustrated in the accompanying drawings in which:

FIG. 1 is a longitudinal section through a first embodiment with the parts shown in the effective working position, FIG. 2 is a longitudinal section through a second embodiment with the parts shown in the working position, FIG. 3 is a longitudinal section in a third embodiment before the strip is inserted, FIG. 4 is a longitudinal section through a fourth embodiment of the invention, with the parts shown in the working position, FIG. 5 is a longitudinal section through a fifth embodiment of the invention before the insertion of the strip, FIG. 6 is a longitudinal section through a sixth embodiment before the insertion of the strip, FIG. 7 shows a detail of the parts illustrated in FIG. 3, FIG. 8 is a longitudinal section through a seventh embodiment of the invention, with the parts shown in the working position, and FIGS. 9 and 10 show details of the arrangement illustrated in FIG. 8.

FIG. 1 shows two parallel metal parts 1 and 2 of plate form, for example of aluminium, which may be employed in window frames; in each case the parts have upper projections, 1' and 2' respectively, and lower projections 1'''' and 2''''. The upper projections 1' and 2' have lower faces inclined at an angle of approximately 45° to the upper faces of parts 1 and 2.

Each of the lower projections 1'''' and 2'''' has a rib portion at right angles to the metal parts 1 and 2 and these have inclined lugs 1'' and 2''.

The metal parts 1 and 2 are held together by a connector comprising a plastic profiled body 3 which serves primarily for heat insulation; this body 3 is pushed in between the parts 1 and 2 at right angles to the plane of the drawings; the body 3 may extend over the complete length of the junction between the metal parts, or may be constituted by separate spaced sections. The plastic profiled body 3 has a bottom transverse wall portion 4 which for example may be provided with an apertured reinforcing steel insert 4'.

The portion 4 has clamping lugs 5 and 6 of strip form which project into the hollow interior of the profiled body 3 and these have hooked tips with inclined faces 7 and 8 which serve as guide surfaces for a wedge strip 9 which can be driven in between them. The strip 9 has at its outer end or head 10 undercuts 13 and 14 with bevel faces 11 and 12 for detent engagement with tips 7 and 8.

In the working position, that is to say when the strip 9, which may be of plastics material or metal, has been driven in, the tips of resilient clamping lugs 5 and 6 engage in the detent portions so as to arrest the strip 9 in position with the lower end 10 then in direct contact with the transverse wall portion 4. The insertable wedge strip 9 has at its upper part parallel side surfaces 9' corresponding to parallel spaced surfaces on the edge parts of the profiled body 3.

The resilient clamping of lugs 5 and 6 against the strip 9 will compensate for any coarse tolerances which arise during the anchoring of the profiled body 3 between the metal parts 1 and 2, as will be described in more detail below. The inclined lower faces of projections 1' and 2' are in linear contact with the corners 17, 18 of body 3. These corners 17 and 18 slide over the said inclined faces when the strip 9 is inserted into body 3.

Body 3 is provided at the surfaces thereof facing the metal parts 1 and 2, with outwardly-bulged parts 19 and 20 which are in intimate contact with the metal parts 1 and 2 when the assembly is in the operative position.

The inner corners 21 and 22 provided at the lower edges of body 3 are in linear contact with the inclined lugs 1'' and 2'' in the embodiment illustrated, and again is of a nature such as to compensate tolerances.

The further the body 3 extends into the hollow area 23, 24 defined bythe lugs 1'' and 2'', the greater was the tolerance deriving from the manufacture of the metal parts 1 and 2. For this reason only linear contact is provided between the corners 17, 18 and the corresponding inclined faces of projections 1', 2' and between the corners 21 and 22 and the corresponding inclined faces of lugs 1'', 2'', and between the curved surfaces 19 and 20 and the metal parts 1 and 2.

The wall portions 25 and 26 of the plastic profiled body 3 are of such a nature that they yield resiliently when the strip 9 is driven into position and when the corners 17 and 18 slide along the inclined faces of projections 1', 2'. Tests applied in the direction at right angles to the metal parts 1 and 2 in the embodiment just described and illustrated show that the connector assembly exhibits a tensile strength of 1200 kg per running meter.

Polytetrafluorethylene is used for the plastic profiled body 3 in the embodiment illustrated and just described. Other materials can however be used, for example with glass fiber reinforcement and temperature-resistant. Such a choice of material has been found useful when the metal parts 1 and 2 are exposed to temperatures of 100° C. and more during anodising. It has even been found of advantage to increase the temperature-resistance of body 3 and strip 9 in some instances up to about 180° C. since the temperatures employed in lacquering of aluminum parts lie within this range.

In the embodiment illustrated in FIG. 2 the aluminum parts 29, 30 of a door frame are provided with tolerance-compensating inclined surfaces 31, 32 in the vicinity of the lower projections only, this producing hollow spaces 37, 38. The plastic profiled body 5 is provided with rounded protuberances 35' which are in contact with the corresponding metal parts 29, 30.

This particular arrangement caters for a further compensation of tolerance because in the area between the side wall portions of the body 35 and their free edges use is made of inclined surfaces 33 and 34 which can 'slide' on edges 36 of the upper projections which in this case jut out at right angles.

With this arrangement the tolerances at the inclined surfaces 33, 34 are increasingly compensated the further the body 35 is depressed into the hollow areas 37, 38.

The strip 39, which is similar in wedge form to the strip 9 and is driven in similar fashion to the latter, produces a closed system of linear forces at the inclined faces 31, 32 and 36.

In the embodiment illustrated in FIG. 3, the free ends of the lower projections 40, 41 are parallel to the metal parts 43 and 44; the upper projections stand out at right angles from the metal parts 43 and 44.

The plastic profiled body 42 is pushed in over the lower projections 40, 41 in a direction at right angles to the plane of the drawing; the metal parts 43 and 44 are fixed at the required spacing and in relative position by virtue of the special form of the lower projections.

In FIG. 3 the connector strip 51 is shown before being driven into position.

At the area of contact with the upper projections 49, 50, or with their "corners" or edges, inclined and stepped faces are provided at the side walls of the plastic profiled body 42. Details of this stepped arrangement 45 and 46 are shown in FIG. 7. A stepped, tolerance-absorbing notching arrangement at the corners or edges 49, 50 are feasible with this body 42.

Body 42 is further provided at its lateral walls 56, 57 with ribs, projections or the like 52, 53. As a result a bending moment is applied to the side walls 56 and 57 by application of these ribs, projections or the like against the corresponding inner sides 54, 55 of the metal parts 43 and 44. This caters for a two-dimensional absorption of tolerance in the end position.

A filler 58 of some other material, for example a foamed plastic, may be provided between the edges surrounding the lower projections of the plastic profiled body 42. The forces which act through the lower projections 40, 41 against body 42 can be better absorbed by this means.

The embodiment illustrated in FIG. 4 starts with a plastic profiled body 42 of similar cross section but in this figure the body is shown in the operative position, that is to say with the strip 51 fully driven home.

The strip 51 is provided with inclined faces 51' for resilient clamping by the clamps 51" and to hold the wedge strip 51 permanently against the bottom wall portion of body 42. The strip 51 is provided at its free end with a plate part 59, 60. This part need not extend over the full length of strip 51 and may also be in the form of aligned spaced parts.

In this embodiment provision is made for ready removal of wedge strip 51. The plate 50, 60 and the corresponding rib simplify pulling out of the strip 51 from the position illustrated in FIG. 4, if needed, for example to enable the metal parts to be changed, re-used, interchanged or replaced.

Release of the strip 51 from the FIG. 4 position can be further facilitated by providing projections 61 of strip form; moreover it is possible to use a recess 62 of hook shape for engagement by an appropriate tool.

In the embodiment illustrated in FIG. 5 a solid section or reinforcement 64 is provided between the lower projections of the aluminum plate parts 43, 44 and this, as illustrated, can be of the same material as the body 42; alternatively however some other material can be used, as illustrated in FIG. 3.

To reinforce the plastic profiled body and to shield it, for example against temperature effects, use is made of a U-shaped clamp 65 of metal strip, for instance of stainless steel, having bowed enlargements and projections which enable it to be applied to the plastic body 42 as a clip or clamp. A further possibility is to construct the metal strip 65 in such a way that it need only be used as a supplementary arrangement during anodising or enamelling, the auxiliary strip 65 being removed after this operation.

In the embodiment illustrated in FIG. 6 use is made of a similar plastic profiled body 68 with an opening 67 in which the neck part of the strip 66 which can even be held against the aluminum plate parts 43, 44 before the body 68 is drawn in at right angles to the plane of the drawing. Consequently in this arrangement the profiled body 68 can be supplied with the strip 66 loosely held therein.

The arrest of the strip in the opening 71 between the clamping lugs with their inclined faces 72 and 73 is effected in the manner described above. The gap between the free lower ends 74, 75 of the plastic profiled body is of U-shape in this arrangement.

In the arrangement illustrated in FIG. 8 use is made of two aluminum plates 101, 102, for example for the frame of a front door of a house. They are insulated at their outer edges by use of a connector 103 of plastic material, for example polytetrafluorethylene. It comprises a hollow profiled body having a bottom wall portion 104, two side wall portion 105 and 106 and portions 107 and 108 which constitute the so-called upper wall portion.

The connecting profiled body 103, which is hollow, extends over the complete length of the two metal parts 1 and 2; strip lengths of up to six meters are possible and quite usual.

The connecting body 103, which is open at the top, is held in the operative position by a wedge strip 109 with side faces 110 and 111 inclined to one another. The inner faces 112, 113 of the opposed parts 107 and 108 of the upper wall portion are inclined correspondingly to these side faces 110, 111. Provided at the lower portion 104 are strip form lugs 120 and 121 which need not extend over the complete length of the connecting strip 103 but can be broken up into spaced lengths. Lugs 120, 121 are of a resilient nature and have noses 122, 123 to hold the enlarged head 124 of the wedge strip 109 in the working position. In this working position the upper face 125 of the wedge projection is flush with the surface 126 of the upper wall portion constituted by the two portions 107 and 108.

At their free edges 130, 131 the two metal parts 101 and 102 have projecting flanges 132, 133 with bevelled lower faces 134, 135 defining an angle of approximately 110° to 120° with the relevant inner face 136, 137 of the metal part.

The connecting strip 103 is correspondingly formed in the zone of the flanges 132, 133, having inclined faces 138, 139 in this area. The free edges 140, 141 of flanges 132, 133 extend parallel to the inner faces 136, 137.

To hold and/or anchor the connecting strip 103 in the working position the metal plates 101, 102 have projections 150, 151 which consist of a rib 152 of strip form which extends parallel to the inner faces 136, 137 and in each case has a freely-projecting lug 154, 155. The faces 156, 157 of lugs 154, 155 extend at a angle of approximately 45° to the corresponding inner face 136, 137 of the metal parts.

The obliquity of these faces 156, 157 may be the same as those of the inclined faces 134, 135 of the projecting flanges 132, 133 whereby by inclined faces run parallel to one another.

To introduce the connecting strip 103 the two moderately resilient side wall portions 105 and 106 can be bent slightly inwards so that contact between the connecting strip with a metal part, for example with a metal part 102, will be made over a relatively narrow area. Contact faces between the connecting strip 103 and the metal part 102 is made in the areas 160, 161 and 162. By this means it is much easier and simpler to draw or push the connecting strip into the retaining areas of the metal parts.

Since however in this embodiment the connecting strip must be very tight and "rattle-free" in the working position, corresponding conformation between the mutual bearing surfaces must be accurately designed. Tolerances of only a fraction of a millimeter can here be allowed.

For reasons stated above, that is to say when the metal parts 1 and 2 are used for example in the door frame of a house, a tolerance of about 1 m/m is sufficient at the part 164 to enable the connecting strip 103 to be introduced relatively easily.

By pushing the wedge strip 109 into the position illustrated in FIG. 8 the slightly resilient side wall portions are forced to assume the end position illustrated in FIG. 8, having regard to their appropriate bearing against the metal parts.

The connecting strip can be removed from its clamped position by a simple cutting of the profiled connecting part 103 or the wedge strip 109 so that for example any metal part damaged by scratching or during anodising can be replaced without the complete connector assembly having to be dispensed with.

In the modified embodiment shown in FIG. 10 only a portion of the metal part 170 and of a connecting assembly 171 corresponding to FIG. 9 have been illustrated. The metal part has a flange 172 with a rounded lower edge 173. The leading edge 174 of this flange extends parallel to the inner face 175 of the metal part 170. This metal part is rounded in the transition areas correspondingly to the rounding of the under edge 173; this corresponds to the inner edge of the rib 150 which extends at right angles to the inner face 134, (FIG. 8).

The projecting metal rib 177 is provided with a lug 178 the inner face 179 of which defines an angle of approximately 45° to the inner face 175 of the corresponding metal part.

The bearing face 180 of the profiled body 171 of the connector assembly in this embodiment runs parallel to the outer face 181 of this body. In this embodiment also a forwardly-projecting strip lug (not shown) is provided on the bottom wall portion 182, this corresponding to the lugs 120 and 121 of FIG. 8.

There is here a difference in the wedge strip from the embodiment of FIG. 8 but only insofar as the wedge strip 109 is constructed at the area thereof towards its free edge in accordance with the bearing face 180, that is to say extends parallel to the metal part 170 at the bearing face 180.

I claim:

1. A connector for spaced metal parts comprising a hollow elongate body of a cross-sectional shape including at least one bottom wall portion, side wall portions adjoining said bottom wall portion and having rounded protruberances for engagement with said metal parts, and upper wall portions connected to said side wall portions; and a separate fastening strip for insertion in said elongate body to enlarge the same and engage it with said metal parts, said strip having the cross-sectional form of a wedge which in the operative position is engaged between said upper wall portions and is in contact with said bottom wall portion.

2. A connector according to claim 1, in which opposed resilient ribs are provided on said bottom wall portion of the said body and project into the hollow interior of the latter, and said fastening strip is provided with an enlarged head for clamping engagement by said resilient ribs.

3. A connector according to claim 1, in which the metal parts are provided with opposed inward projections for linear engagement by said side wall portions of said hollow body when the latter is enlarged by insertion of the fastening strip.

4. A connector according to claim 3, in which said side wall portions are notched at last in the area of contact with said inward projections.

5. A connector according to claim 1, in which the hollow elongate body cross-section further includes a transitional section between each said side wall portion and the adjacent upper wall portion said transitional section having a flat surface defining an angle of a maximum of 90° with that of the adjacent side wall portion.

6. A connector according to claim 1, in which the metal parts are equipped with internally projecting ribs for engagement with said hollow body, said ribs each being of L-shape with the stem of the L adjoining the metal part and the free-limb of the L defining an angle of between 45° and 80° with the inner face of the corresponding metal part.

7. A connector according to claim 1, in which opposed marginal faces of the upper wall portions of said hollow body extend substantially parallel to one another.

8. A connector according to claim 1, in which the fastening strip is provided with a closure plate.

9. A connector for spaced metal parts comprising a hollow elongate body of a cross-sectional shape including at least one bottom wall portion, side wall portions adjoining said bottom wall portion, upper wall portions connected to said side wall portions, and a rounded transitional section between each side wall portion and the adjacent upper wall portion; and a separate fastening strip for insertion in said elongate body to enlarge the same and engage it with said metal parts, said strip having the cross-sectional form of a wedge which in the operative position is engaged between said upper wall portions and is in contact with said bottom wall portion.

* * * * *